United States Patent [19]

Carbonnel

[11] 4,003,560

[45] Jan. 18, 1977

[54] GAS-TREATMENT PLANT FOR MOLTEN METAL

[75] Inventor: Henri Carbonnel, Antony, France

[73] Assignee: Groupement pour les Activities Atomiques et Advancees "GAAA", Le Plessis Robinson, France

[22] Filed: May 12, 1976

[21] Appl. No.: 685,609

[30] Foreign Application Priority Data

May 27, 1975 France ..... 75.16422

[52] U.S. Cl. ..... 266/217; 75/93 E

[51] Int. Cl.[2] ..... C22B 21/06

[58] Field of Search ..... 75/68 R, 93 E; 266/208, 266/209, 217, 218, 220, 234, 237

[56] References Cited

UNITED STATES PATENTS

| | | | |
|---|---|---|---|
| 3,715,112 | 2/1973 | Carbonnel | 266/220 |
| 3,961,778 | 6/1976 | Carbonnel et al. | 266/217 |

*Primary Examiner*—Gerald A. Dost

*Attorney, Agent, or Firm*—Sughrue, Rothwell, Mion, Zinn & Macpeak

[57] ABSTRACT

Molten corrosive metals such as aluminium are treated, especially for purification, by injecting of gases such as chlorine or nitrogen. This gas-treatment plant comprises a gas-treatment device immersed in a part of a furnace containing molten metal; an electromagnetic pump, situated above the gas-treatment device, stirs the mixture of gas and metal by counter-pressure operation and slag is formed in a decanting tank.

9 Claims, 2 Drawing Figures

GAS-TREATMENT PLANT FOR MOLTEN METAL

BACKGROUND OF THE INVENTION

1. Field of the Invention

The present invention relates to an installation for the treatment of molten metal by bubbling gas therethrough. Such treatment is usually to purify the molten metal.

DESCRIPTION OF THE PRIOR ART

Various devices are known for treating molten metals by bubbling a gas such as chlorine, or nitrogen through a bath of metal with a view to removing impurities and trapped gases from the metal in the bath.

More particularly, a device enabling continuous treatment of a corrosive molten metal such as aluminium has been produced, which device is constituted mainly by an electromagnetic pump with a pipe made of a material having a predetermined porosity. This porous pipe is disposed inside a metallic tube, substantially coaxial therewith and sealed thereto. The space extending between the metallic tube and the porous pipe is connected to a source of pressurized gas for treating the metal. The arrangement is such that the gas passes through the porous pipe into the molten metal and is fairly intimately mixed with the impure molten metal by currents induced by the windings of the electromagnetic pump.

An industrial installation for the purification of molten metal is also known in which an electromagnetic pump is immersed in a casting ladle containing the molten metal to be treated and is connected in series with a purification device as described above, (i.e. itself constituted by an electromagnetic pump with a porous ceramic pipe sealed in a fluid-tight manner inside a metallic tube connected to a source of gas under pressure). The lower part of the purification device is therefore connected to the immersed electromagnetic pump and the upper part of the purification device is connected to a decanting and degassing tank. A slight depression in relation to the atmospheric pressure, in the order of 1 to 100 torr, is maintained in this tank by means of a pump having a very large discharge rate.

In this way, the known installation as a whole is constituted by an immersed electromagnetic pump feeding a purification device which discharges into a decanting tank kept at a pressure close to atmospheric pressure by a high-discharge pump.

To ensure a good mixing of the gases in the purification device with the molten metal, the immersed pump operates in the rising direction, while the purification device uses counter-pressure opertion. Eddy currents of very short radius in the rising mass of molten metal ensure satisfactory mixing of the applied gas with the molten metal and consequent satisfactory purifying of the molten metal.

SUMMARY OF THE INVENTION

The present invention provides a gas-treatment plant for molten metal comprising a gas-treatment device in the form of an electromagnetic pump having a pipe of porous material surrounded by a metal tube and sealed thereto to form a chamber around the porous material, the chamber being connected to a source of pressurised gas for treating molten metal, and an intermediate electromagnetic pump connecting the gas-treatment device to a decanting and degassing tank, wherein the gas-treatment device is immersible in molten metal so that in operation molten metal passes through the gas-treatment device, to the intermediate pump and thence to the decanting and degassing tank.

It is specified that at the surface of the decanting tank, a high-discharge vacuum pump sets up only a slight reduction in pressure. Indeed, such a pressure reduction, while enabling the vacuum pump to absorb the gases escaping from the molten metal, accelerates the drawing off of impurities towards the surface of the molten metal. This pressure must remain in the order of 1 to 100 torr below the atmospheric pressure. If the pressure is reduced further the stirring of the impurities can be too energetic, which can lead to their being partly re-absorbed by the molten metal.

An embodiment of the invention is described by way of example with reference to the accompanying drawings. BRIEF DESCRIPTION OF THE DRAWINGS FIG. 1 is a side view partially in section of one metal treating installation; comprising an embodiment of the present invention.

FIG. 2 shows a diagrammatic cross-section of the main parts of the installation shown in FIG. 1.

DESCRIPTION OF THE PREFERRED EMBODIMENT

Figure 1:
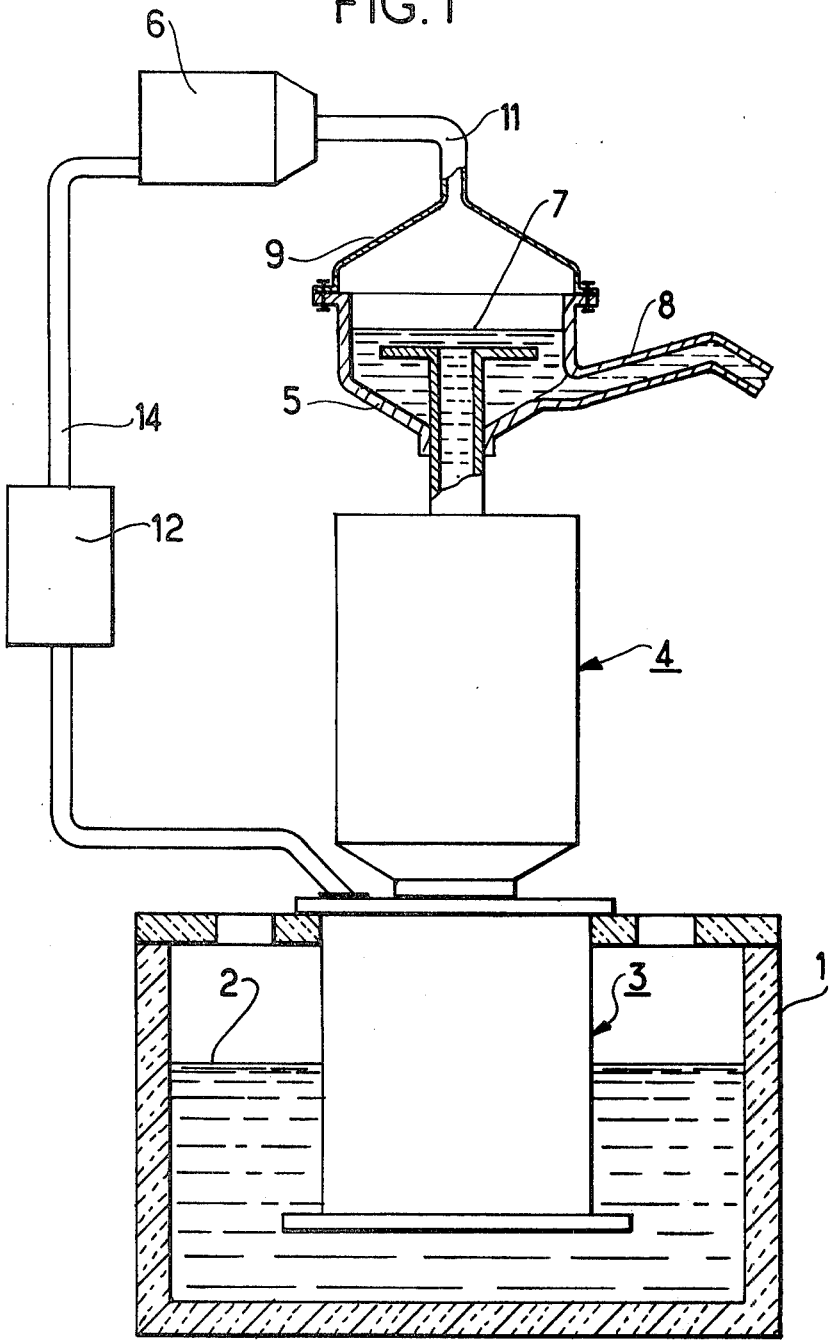

FIG. 1 shows a furnace containing molten metal 2. A purification device 3 is immersed in the molten metal 2. The output of the purification device 3 is connected directly to an electromagnetic pump 4. The output of the electromagnetic pump leads into a decanting and degassing tank 5 containing molten metal 7. A vacuum pump 6 (which can be a simple air nozzle) maintains a pressure slightly below atmospheric pressure in the decanting tank 5, above the level of the molten metal 7. A spout 8 draws off the purified molten metal 7 from below its surface in order to avoid drawing off slag which floats thereon.

The decanting tank 5 is covered by a removable fluid-tight hood 9, extended at its top by a pipe 11 leading to the vacuum pump 6.

When too much slag has formed at the surface of the decanting tank, the removable hood is lifted and the slag is extracted without interrupting the operation of the device.

During normal operation, the electromagnetic pump 4 operates in the reverse direction, while the purification device 3 operates as a rising pump. The purification device 3 is equipped, for this purpose, with an annular stator. Local eddies which are caused by the rising movement of the molten metal are formed all along the bore of the purification device 3. These eddies continue through the electromagnetic pump 4 and thus maintain the mixing of the gas with the molten metal until the mixture arrives the decanting tank 5.

When it is required to extract the gas, particularly nitrogen, with a view to re-injecting it into the molten metal circuit, the gas is collected at the output of the vacuum pump 6 and is conveyed through a pipe 14 to a gas purifyer 12, where the gas is drawn through oil filters and hydrogen traps by an overpressure fan. For chlorine treatment, the vacuum pump can be replaced by a simple air nozzle.

Figure 2:
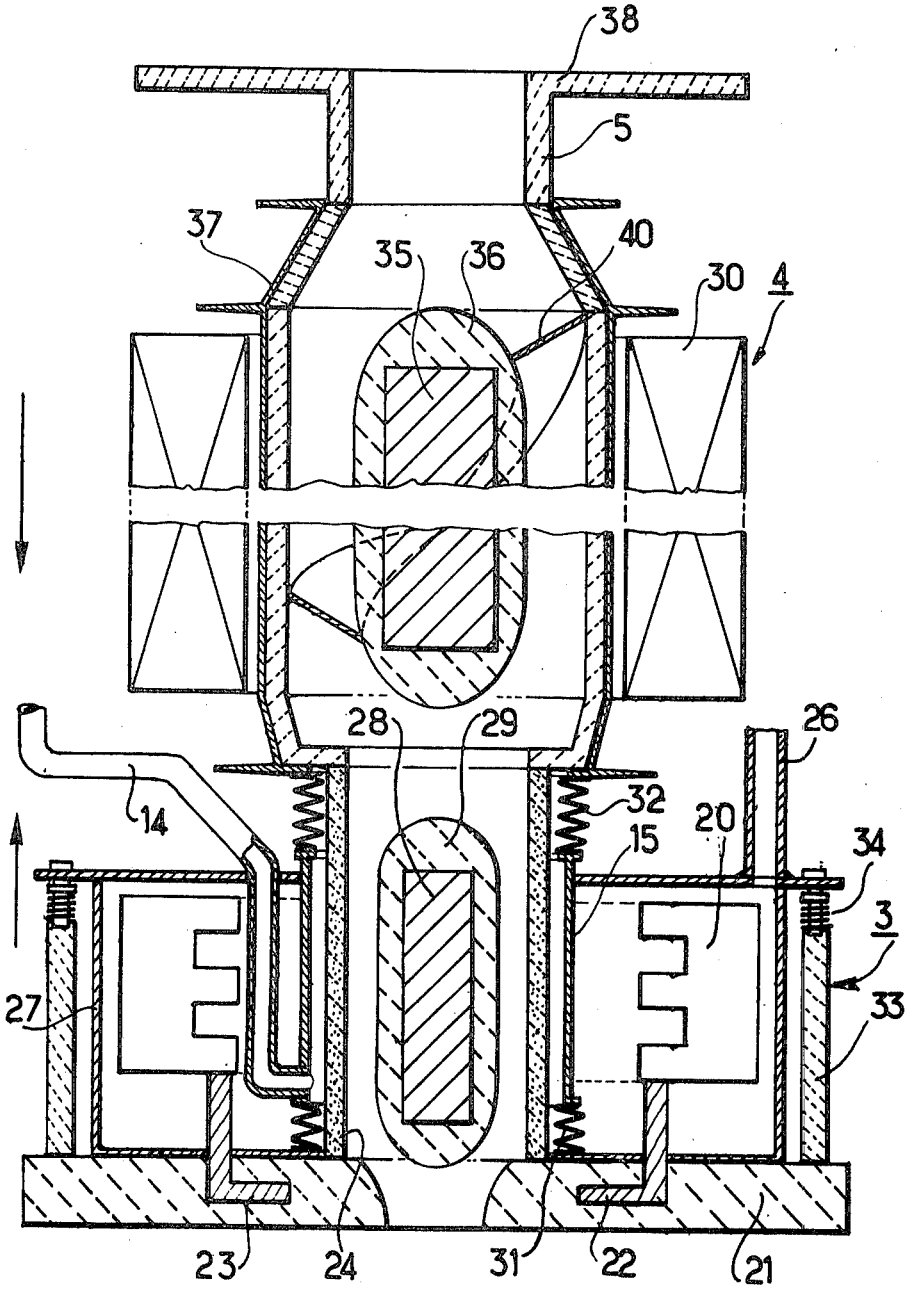

FIG. 2 is a diagrammatic cross-section of the main features of the installation, showing the purification device 3 which operates in the rising direction and the electromagnetic pump 4 which uses counter-pressure operation. A winding assembly, comprising magnetic metal sheets 20, rests on a ceramic base 21; the magnetic mass is supported by two shoes 22 and 23 sunk into the ceramic substance of the base 21, to provide rigidity to the assembly. The gas is injected via a pipe 14 into an enclosure of the purification device 3 between a porous pipe 24 and a metallic tube 15. The magnetic metal sheets and the windings are cooled by air from a pipe 26. The assembly formed by the magnetic masses and the windings is contained in a fluid-tight enclosure 27. The internal wall of the enclosure 27 is the outside surface of the tube 15 containing the gas. The purification device 3 has a magnetic core 28 sunk in a ceramic mass 29. Fluid-tight sealing around ends of the tube 15 is obtained by means of bellows 31 and 32. Sealing between ceramic parts is obtained by resilient means, such as, for example screw and spring devices 34, acting on an outer protection wall 33.

The electromagnetic pump 4 comrpises an exterior winding 30 and a large core 35 placed in a protective ceramic casing 36. This core is suspended by a metallic sheet 40 formed in the shape of a helical screw. The result of this is that the molten metal flow is divided on passing through the pump 4 and that its path is considerably lengthened, all this further contributing to improving of the mixing within the molten metal. The gas-tight sealing of the ceramic wall of the pump is reinforced by a continuous metallic casing 37. The upper part of the pipe 5 is surrounded by an annular rim 38 ensuring the dispersal of the molten metal towards the periphery of the decanting tank via a shallow portion facilitating the degassing of the molten metal.

Although the method and the device which have just been described appear to provide the greatest advantages for the implementing of the invention, it will be easily understood that various modifications can be made thereto without going beyond the scope of the invention, it being possible, more particularly, to replace some elements by others capable of fulfilling the same technical function or an equivalent technical function therein, it being possible, for example, to replace the furnace by a casting ladle.

What is claimed is:

1. Gas-treatment plant for molten metal comprising a gas-treatment device in the form of an electromagnetic pump having a pipe of porous material forming a bore surrounded by a metal tube and sealed thereto to form a chamber around the porous material, means connecting said chamber to a source of pressurized gas for treating molten metal, a decanting and degassing tank, and an intermediate electromagnetic pump overlying said gas-treatment device and connecting the gas-treatment device to said decanting and degassing tank, and said gas-treatment device being immersible in molten metal whereby; in operation, molten metal passes through the gas-treatment device to the intermediate pump and thence to the decanting and degassing tank.

2. Gas-treatment plant for molten metal according to claim 1, wherein the electromagnetic pump of the gas-treatment device has an annular stator surrounding the metal tube and including means for air cooling said stator while immersed in molten metal.

3. Gas-treatment plant for molten metal according to claim 1, wherein the electromagnetic pump of the gas-treatment device has a magnetic core located in the bore of the pump and coated in ceramic material.

4. Gas-treatment plant for molten metal according to claim 1, wherein the intermediate pump has a magnetic core located in its bore, which core is coated in ceramic material.

5. Gas-treatment plant for molten metal according to claim 4, wherein the intermediate pump has an active region with a relative large diameter bore, the said core is located in the region of larger diameter bore.

6. Gas-treatment plant for molten metal according to claim 5, wherein the said core is fixed in the bore by a metal sheet helical screw.

7. Gas-treatment plant for molten metal according to claim 1, wherein the intermediate pump has a metal casing which is connected to the tube of the gas-treatment device by fluid-tight metallic bellows.

8. Gas-treatment plant for molten metal according to claim 1, wherein the intermediate pump is arranged to operate in opposition to the pump of the gas-treatement device so that in operation molten metal flows from the gas-treatment device to the decanting and degassing tank through a region of increased turbulence for improved mixing of gas and metal.

9. Gas-treatment plant for molten metal according to claim 1, further including a high-discharge vacuum pump coupled to said decanting and degassing tank to remove gas from the decanting and degassing tank.

* * * * *